US009700163B2

(12) United States Patent
Kobayashi

(10) Patent No.: US 9,700,163 B2
(45) Date of Patent: Jul. 11, 2017

(54) SYNTHETIC RESIN CUP CONTAINER

(71) Applicant: Takayuki Kobayashi, Tokyo (JP)

(72) Inventor: Takayuki Kobayashi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 392 days.

(21) Appl. No.: 14/348,761

(22) PCT Filed: Sep. 26, 2012

(86) PCT No.: PCT/JP2012/074641
§ 371 (c)(1),
(2) Date: Mar. 31, 2014

(87) PCT Pub. No.: WO2013/047554
PCT Pub. Date: Apr. 4, 2013

(65) Prior Publication Data

US 2014/0246351 A1 Sep. 4, 2014

(30) Foreign Application Priority Data

Sep. 30, 2011 (JP) ..... 2011-216935
Sep. 30, 2011 (JP) ..... 2011-216975

(51) Int. Cl.
*B65D 51/16* (2006.01)
*A47G 19/22* (2006.01)
(Continued)

(52) U.S. Cl.
CPC ..... *A47G 19/2205* (2013.01); *B65D 43/021* (2013.01); *B65D 43/0229* (2013.01);
(Continued)

(58) Field of Classification Search
CPC ..... B65D 43/021; B65D 43/0229; B65D 51/1622; B65D 77/2004;
(Continued)

(56) References Cited

U.S. PATENT DOCUMENTS 2,251,987 A * 8/1941 Conway, Jr. ..... B65D 7/46 220/258.3
3,278,014 A * 10/1966 Thornton ..... B65D 85/816 206/217
(Continued)

FOREIGN PATENT DOCUMENTS

JP 53-157055 12/1978
JP 38-19188 B2 9/2006
(Continued)

OTHER PUBLICATIONS

Dec. 25, 2012 International Search Report issued in International Application No. PCT/JP2012/074641.
(Continued)

*Primary Examiner* — Luan K Bui
(74) *Attorney, Agent, or Firm* — Oliff PLC

(57) ABSTRACT

A synthetic resin cup container including two members: a cup body having a cylindrical shape and a bottom disposed at a lower end of a round peripheral sidewall of this cup body, and a flange unit including a fitting cylinder and a brim-like flange, an inner edge portion of the flange being integrally connected to an upper end of the fitting cylinder, wherein the flange unit is detachably fitted in an upper portion of the cup body by fitting the fitting cylinder in an upper portion of the peripheral sidewall.

8 Claims, 12 Drawing Sheets

(b)

(51) Int. Cl.
*B65D 77/20* (2006.01)
*B65D 43/02* (2006.01)

(52) U.S. Cl.
CPC ..... *B65D 51/1622* (2013.01); *B65D 77/2004* (2013.01); *B65D 2543/0024* (2013.01); *B65D 2543/00092* (2013.01); *B65D 2543/00231* (2013.01); *B65D 2543/00296* (2013.01); *B65D 2543/00518* (2013.01); *B65D 2543/00546* (2013.01); *B65D 2543/00629* (2013.01); *B65D 2543/00685* (2013.01); *B65D 2543/00731* (2013.01); *B65D 2543/00796* (2013.01)

(58) Field of Classification Search
CPC ..... B65D 2543/00796; B65D 2543/00096; B65D 2543/00231; B65D 2543/0024; B65D 2543/00296
USPC ..... 206/217, 524.6, 497; 220/202, 203.01, 220/254.1, 255.1, 257.1, 258.1, 258.3, 220/360, 367.1, 796, 798, 801, 359.1, 220/359.4, 366.1, 785
See application file for complete search history.

(56) References Cited

U.S. PATENT DOCUMENTS 3,381,872 A * 5/1968 Holder ..... B65D 43/021 220/785
3,613,938 A * 10/1971 Westcott ..... B65D 21/0233 220/366.1
3,945,529 A * 3/1976 Haag ..... B65D 51/20 220/254.1
4,018,904 A * 4/1977 Muraoka ..... B65D 55/0854 206/217
4,202,463 A * 5/1980 Mogler ..... B65D 39/084 217/110
4,348,421 A * 9/1982 Sakakibara ..... B65D 85/816 206/217
5,743,427 A 4/1998 Monus
6,082,576 A * 7/2000 Counts-Bradley ..... B65D 39/04 220/787
8,827,097 B2 * 9/2014 Antal, Sr. ..... B65D 43/0212 220/785
2005/0189351 A1 * 9/2005 Clarke ..... B65D 51/145 220/254.1
2007/0074979 A1 * 4/2007 Cho ..... B65D 51/1672 206/219
2009/0250461 A1 * 10/2009 Syrkos ..... B65D 47/248 220/254.1
2011/0186536 A1 * 8/2011 Wurster ..... B65D 79/005 215/307

FOREIGN PATENT DOCUMENTS

JP 43-10851 B2 8/2009
JP 2010-195440 A 9/2010

OTHER PUBLICATIONS

Chinese Notification of Reasons for Refusal issued in Chinese Patent Application No. 2012800041161.

* cited by examiner (a)

(b)

SYNTHETIC RESIN CUP CONTAINER

TECHNICAL FIELD

This invention relates to a cup container made of a synthetic resin.

BACKGROUND ART

Cup containers have many use applications as simple, disposable containers in various fields of foods and beverages including coffee, juice, yogurt, and the like (See, for example, Patent Document D1). FIG. 12 is a front view, with a right half in a vertical section, of a typical example of a conventional cup container. The cup container 101 as a whole has a cylindrical shape with a bottom. At a lower end of a peripheral sidewall 103 in a cylindrical shape, the sidewall 103 is connected to the bottom 106. At an upper end of the peripheral sidewall 103, a brim-like flange 116 surrounds an upper edge of the sidewall 103.

After the cup of this type has been filled with a content fluid, such as coffee, the cup is usually completed when an upper opening of the cup is sealed by adhering a rim portion of a round seal film 119 to an upper surface of the flange 116, as shown in FIG. 12. The consumer peels off the seal film 119 to sip the content fluid directly, or stabs a straw into the seal film 119 to suck up the drink. The flange 116 serves partly for sealing, partly for performing a function of controlling deformation of the upper opening, and partly as a portion with which support claws come in contact to retain the posture of the cup container in a cup-supplying device in the equipment for filling the cups with a content fluid (hereinafter referred to as the support portion). The flange 116 is also used to hold the cups in a transfer retainer of the filling equipment, and thus, is indispensable for the containers of this type.

The cup container products of this type filled with a content fluid may be sold by heating them in a heater or a microwave oven under the condition that the upper opening has been sealed as described above, or the users themselves may heat a sealed cup container to have a hot drink.

PRIOR ART REFERENCES

Patent Documents

Patent document D1: Publication number JP2010-195440 A

DISCLOSURE OF THE INVENTION

Technical Problems to be Solved by the Invention

As described above, the flange 116 is an essential portion of the cup container of this type. However, specifically if the users try to peel off the seal film 119 to sip a content fluid directly from the cup, an arising problem is that this flange 116 gets in their way, and the users may feel difficult to swallow or may have a feeling of strangeness on their lips.

If a cup container product filled with a content fluid is heated in a heater or a microwave oven under the condition that the upper opening has been sealed as described above, then the container inside is brought to a pressurized state. This pressurization creates a safety problem because the content fluid may spout from the cup at the moment when the user peels off the seal film or stabs a straw into the seal film 119 to take a sip. Furthermore, since the container deforms into a swelling state, the user would feel uneasy, and merchantability of the cup products would decrease.

A first technical problem of this invention is to solve problems of difficulty in swallow and an uncomfortable touch to the lips caused by a flange of the cup containers having the flange. A second technical problem of this invention is to control an increased pressure inside a cup container caused by heating the cup container filled with a content fluid in a heater or a microwave oven under the condition that the upper opening of the cup has been sealed.

Means of Solving the Problems

A main feature of this invention to solve the above-described problems is a synthetic resin cup container comprising two members: a cup body having a cylindrical shape and a bottom disposed at a lower end of a round peripheral sidewall of this cup body, and a flange unit comprising a fitting cylinder and a brim-like flange, an inner edge portion of the flange being integrally connected to an upper end of the fitting cylinder, wherein the flange unit is detachably fitted in an upper portion of the cup body by fitting the fitting cylinder in an upper portion of the peripheral sidewall.

When the cup container having the above-described feature is put under the condition that the flange unit has been fitted to the cup body, the flange performs a function of preventing deformation of the upper opening or a function of a support portion in the cup-supplying device, as found in ordinary cup containers having a flange. If the above cup container is used as a drink, the flange unit can be removed, and one can drink the content fluid directly from the cup. Because of this removable flange unit, there are no longer the problems caused by the flange, such as the difficulty in swallow and the uncomfortable touch to the lips. By the way, between the cup body and the flange unit, a liquid-tight sealing function can be achieved by an engagement of the flange underside with an upper edge of the peripheral sidewall of the cup.

Another feature of this invention is that in the above-described main feature, a rim portion of a circular seal film is adhered to an upper flange surface of the flange unit to seal an upper opening of the flange unit.

The cup container products filled with a content fluid, such as coffee, are generally utilized by sealing the upper opening with a seal film, as described above. In this invention, the flange unit can be removed to take a sip of the drink, and can be fitted again to the cup body, with the upper opening of the flange unit being maintained in the sealed state. Thus, the cup container having the rest of the content fluid kept inside can be stored at ease or even carried around. Meanwhile, it is preferred to use a condition safer than a bare cup for the sales of the cup container products having a content fluid filled therein, as by using a shrink film to cover a region of the cup ranging from a rim portion of the seal film to the peripheral sidewall of the cup body.

Still another feature of this invention is that in the above-described main feature, one or more inner peripheral ridges is/are formed in an upper inner surface area of the peripheral sidewall, and one or more peripheral grooves is/are formed at a corresponding position or positions on an outer surface of the fitting cylinder, wherein the fitting cylinder is fitted in an upper portion of the peripheral sidewall by a set-in engagement of the inner peripheral ridges with the peripheral grooves.

The above-described feature is concerned with a locking function that prevents the flange unit from coming off the cup body at the time when upward drawing force acts on the flange, for example, in the cup-supplying device. The peripheral ridges are formed in an upper portion of the inner wall of the cup body, and have an action-and-effect as peripheral ribs. Even after the flange unit has been removed, the peripheral ridges can prevent the upper opening of the cup body from deformation. The engagement of the peripheral ridges with the peripheral grooves performs not only the locking function, but also a sealing function as described above.

Still another feature of this invention is that in the above-described main feature, the fitting cylinder is fitted in an upper portion of the peripheral sidewall by a screw engagement.

According to the above-described feature, a screw engagement mechanism can be used to fit the flange unit firmly to the cup body. Because of this engagement, the locking function is performed reliably so that the flange unit would not escape from the sidewall when upward drawing force acts on the flange. This firmly fitted flange unit can be removed merely by unscrewing it. It is preferred that an irregular surface pattern, such as knurling, is put on the flange for a nonslip purpose so that the flange unit can be screwed or unscrewed easily.

Still another feature of this invention is that in the above-described main feature, one or more gas venting grooves (16*g*) is/are formed on the underside of the flange at a point or points of flange base in the direction of outer peripheral edge.

The cup containers having the above-described features are sold as cup container products in which the upper opening of the flange unit is generally sealed with a seal film after the cup has been filled with a content fluid. According to the above-described features, the peripheral sidewall of the cup body swells with an increase in pressure inside the container when the content fluid is heated in a heater or a microwave oven. This swell causes a gap to be formed between the peripheral sidewall and the fitting cylinder of the flange unit, which has been fitted in the upper portion of this peripheral sidewall. The gas inside the container can be escaped through this gap and one or more gas venting grooves formed on the underside of the flange at a point or points of flange base in the direction of outer peripheral edge. Thus, the pressure inside the container can be effectively controlled.

Effects of the Invention

The synthetic resin cup container of this invention having the above-described features has the following effects:

According to the main feature of this invention, the cup container comprises a cup body and a flange unit. Like any ordinary cup container having a flange, the cup container of this invention allows the flange unit to perform the function of preventing deformation of the upper opening and/or a function as a supporting member necessary in the cup-supplying device. When a sip is taken from the cup container, the flange unit can be removed so that the content fluid can be directly swallowed from the cup. Because of this removable flange unit, there are no longer the problems caused by the flange, such as the difficulty in swallow and the uncomfortable touch to the lips.

According to the feature of this invention, in which the upper opening of the flange unit is sealed with a seal film, the flange unit can be removed for some sips of the drink, and then can be fitted again to the cup body, while the upper opening of the flange unit is kept in the sealed state. Thus, the cup container having the remaining content fluid inside can be stored or even be carried around with ease.

One or more gas venting grooves is/are formed in the underside of the flange in case the peripheral sidewall of the cup body swells with an increase in pressure inside the container when the content fluid is heated in a heater or a microwave oven. This swell would result in a gap formed between the peripheral sidewall and the fitting cylinder of the flange unit, which has been fitted in the upper portion of this peripheral sidewall. The gas inside the container can escape through this gap and the one or each gas venting groove formed in the underside of the flange at a point of flange base in the direction of outer peripheral edge. Thus, the pressure inside the container can be effectively controlled. The cup containers can be used and served safely and reliably in the applications of use in which the content fluids are sold or used by previously heating them.

BRIEF DESCRIPTION OF THE DRAWINGS

FIG. 8(*b*) is a diagrammatic perspective view similar to FIG. 8(*a*), in which the container inside is in a pressurized state.

DESCRIPTION OF REFERENCE SIGNS

Figure 1:
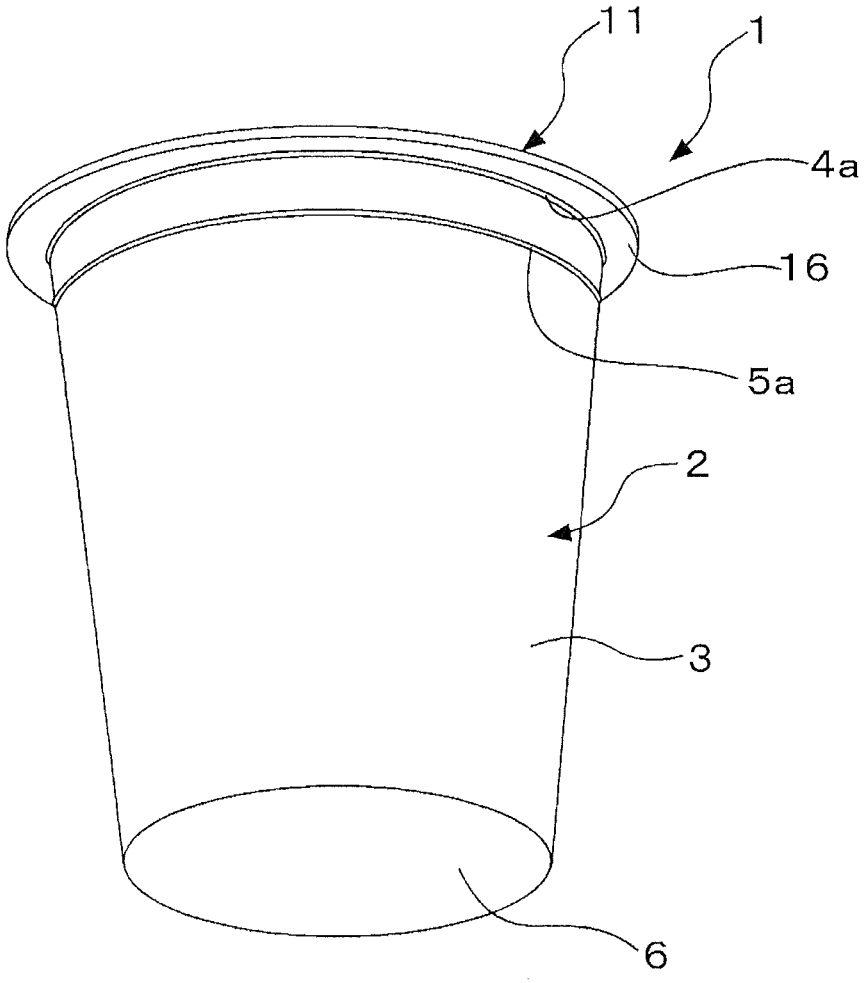
FIG. 1 is a diagrammatic perspective view taken from an obliquely upward line of sight, which shows a first embodiment of the cup container of this invention.

1. Cup container
2. Cup body
3. Peripheral sidewall
4, 5. Inner peripheral ridge
4*a*, 5*a*. Outer peripheral ridge
6. Bottom

7. Screw thread
11. Flange unit
12. Fitting cylinder
14, 15. Peripheral groove
16. Flange
16*g*. Gas venting groove
17. Spiral groove
18. Irregular surface pattern (Knurling)
19. Seal film
S. Gap
101. Cup container
103. Peripheral sidewall
106. Bottom
116. Flange
119. Seal film

BEST MODES FOR CARRYING OUT THE INVENTION

Figure 2:
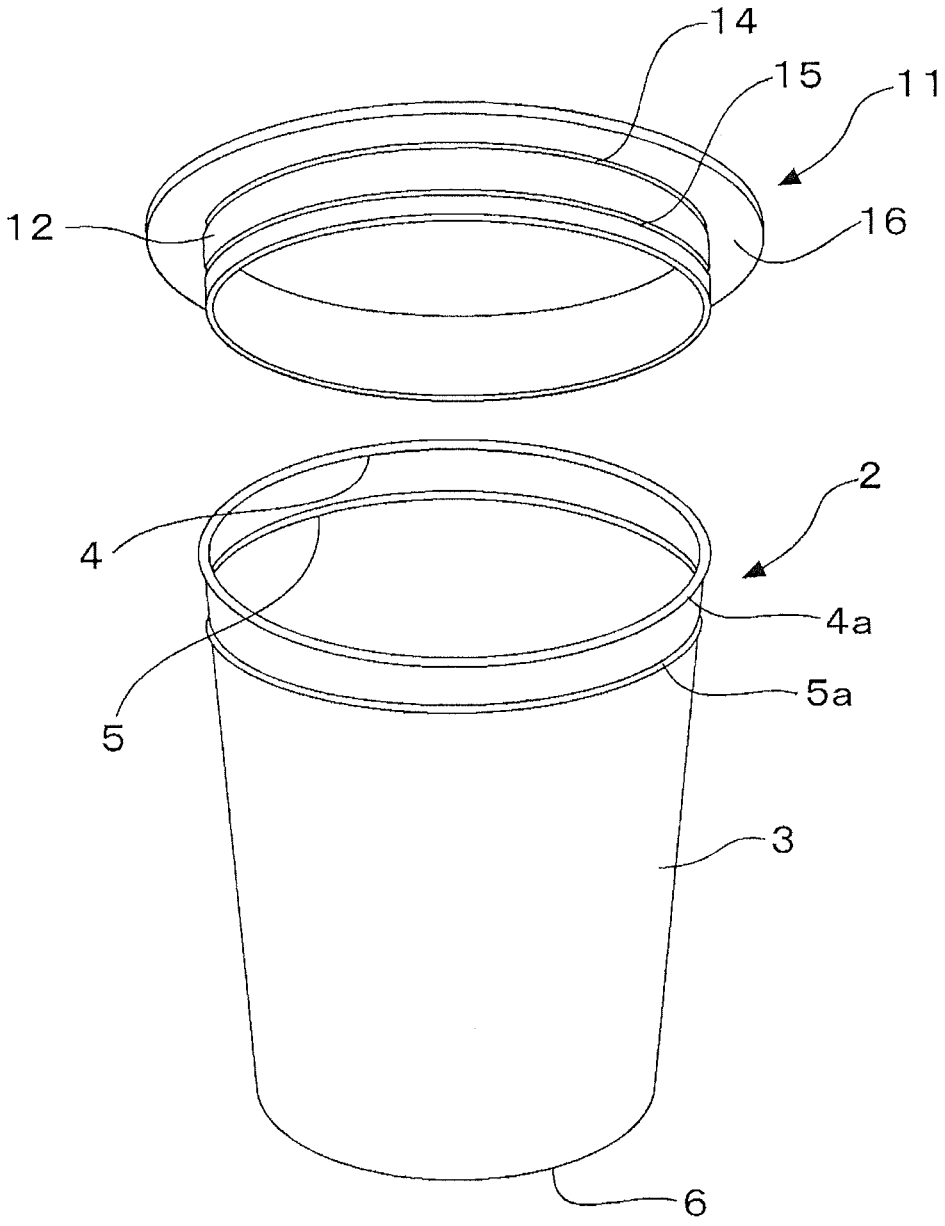
FIG. 2 is a diagrammatic perspective view of the cup container of FIG. 1, in which the flange unit is in a state detached from the cup body.
Figure 3:
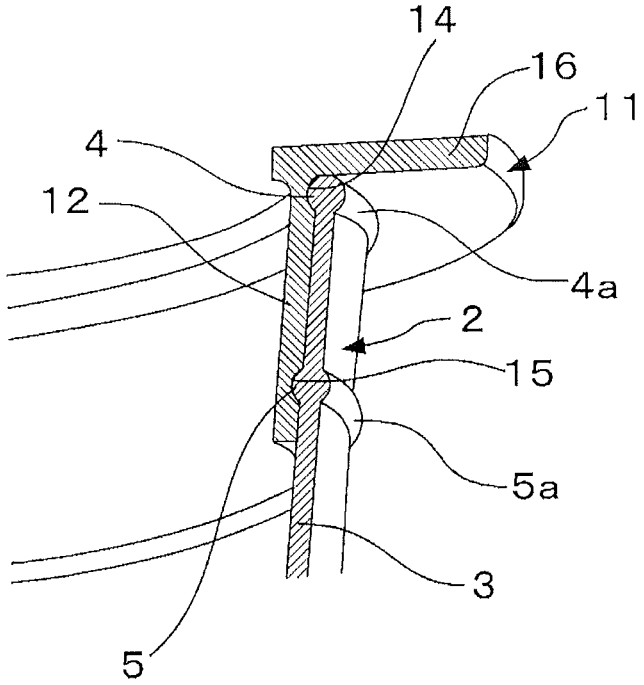
FIG. 3 is an enlarged diagrammatic perspective view of an important upper portion of the cup container of FIG. 1, with a part in a vertical section.
Figure 4:
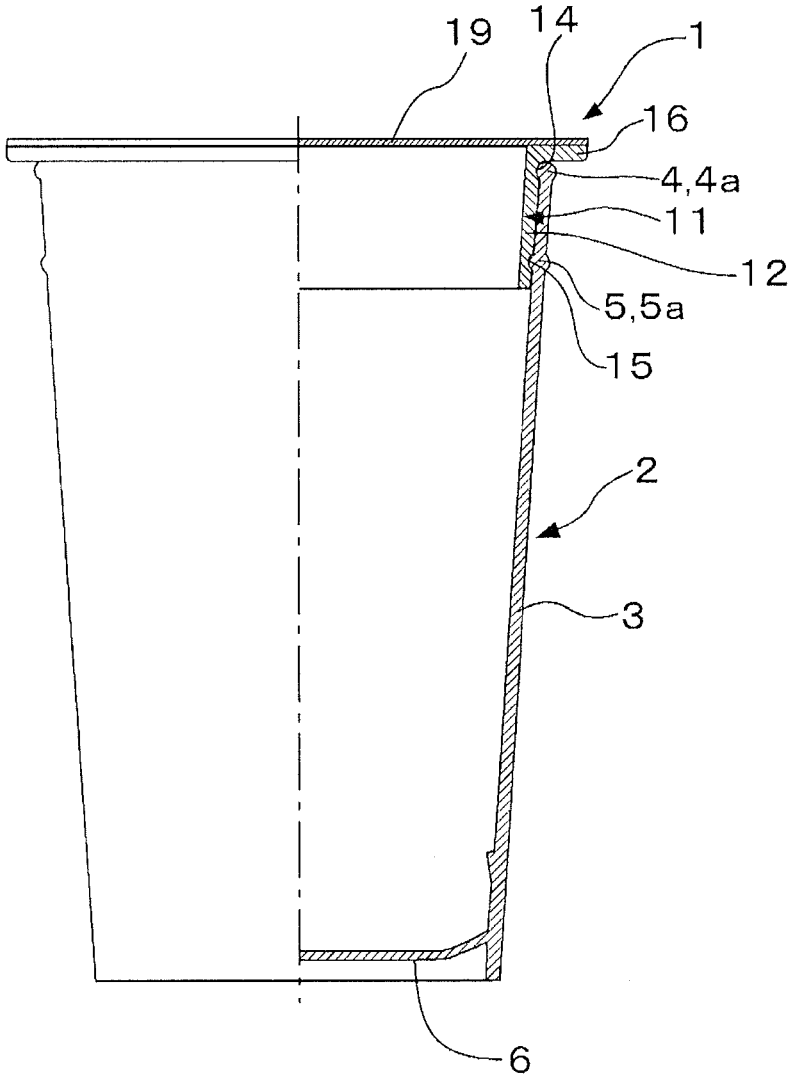
FIG. 4 is a front view, with a right half in a vertical section, of the cup container of FIG. 1.

This invention is further described with respect to preferred embodiments, now referring to the drawings. FIGS. 1 to 4 shows a synthetic resin cup container in a first embodiment of this invention, in which FIG. 1 is a diagrammatic perspective view; FIG. 2, a diagrammatic perspective view of the cup container of FIG. 1, in which a flange unit 11 is in a state detached from a cup body 2; FIG. 3, an enlarged diagrammatic perspective view of an important upper portion of the cup container of FIG. 1, with a part in a vertical section; and FIG. 4, a front view, with a right half in a vertical section, of the cup container of FIG. 1. FIG. 4 shows the upper opening of the flange unit 11 which is sealed with a seal film 19 in such a way that a rim portion of the seal film 19 is adhered to an upper surface of a flange 16 of the flange unit 11.

The cup container 1 in this first embodiment is made of a polypropylene (PP) resin, and comprises two members of the cup body 2 and the flange unit 11. The cup body 2 has a peripheral sidewall 3 in a cylindrical shape, which gradually narrows in the downward direction. A bottom 6 is disposed integrally with the peripheral sidewall 3 at its lower end. The flange unit 11 is made of a low-density polyethylene (LDPE) resin, and comprises a cylindrical fitting cylinder 12, which gradually narrows in the downward direction, and the flange 16, which has a brim shape and extends outward from an upper edge of the fitting cylinder 12.

As shown in details in FIG. 3, a pair of inner and outer peripheral ridges 4, 4*a* is disposed on the inner and outer surfaces in the upper portion of the peripheral sidewall 3 of the cup body 2. Another pair of inner and outer peripheral ridges 5, 5*a* is disposed at a small distance below the peripheral ridges 4, 4*a*. Peripheral grooves 14, 15 are also disposed in the outer peripheral surface of the fitting cylinder 12 of the flange unit 11 at height positions opposed to the inner peripheral ridges 4 and 5 formed on the inner surface of the peripheral sidewall 3. As shown in FIGS. 3 and 4, the flange unit 11 is fitted in the upper portion of the peripheral sidewall 3 of the cup body 2 under a condition that the inner peripheral ridges 4, 5 have been tightly engaged with the peripheral grooves 14, 15. Because of this engagement of the inner peripheral ridges 4, 5 with the peripheral grooves 14, 15, a locking function is performed to prevent the flange unit 11 tearing loose from the cup body 2 when the flange 16 is pulled upward, e.g., in the device for supplying the cup containers 1.

The locking function utilizing the fitting engagement of the inner peripheral ridges 4, 5 with the peripheral grooves 14, 15 need be adjusted to a level that is strong enough to prevent the flange unit 11 from tearing loose in the cup-supplying device described above and yet is easy fit for the flange unit 11 to be removed from the cup by the force of both hands when the user take a sip of the drink. Such strength of the locking function can be adjusted by the cross-sectional shape of the ridges and the grooves, the number of them, and the positions at which they are disposed.

Obviously, the locking function is not limited to the combination of peripheral ridges and grooves, but various other locking mechanisms can also be used. For example, a climbing-over locking mechanism can be used by combining ridges with ridges, while taking into consideration a difference between the direction of force acting inside the cup-supplying device and the direction of force acting in the manual insertion and removal of the flange unit. In the cup-supplying device, there acts the force that pulls out the flange unit 11 upward by way of the flange 16. In comparison, manual removal of the flange unit 11 requires turning the flange unit 11 relative to the cup body 2 or pulling the flange unit 11 upward away from the cup body 2. Thus, the locking function is designed while taking the difference in the action of force into consideration, so that the force can be balanced between the resistance of the flange unit 11 against the force pulling it upward in the cup-supplying device and the easy detachability of the flange unit 11 required when the user removes it by hands.

The cup container 1 of this first embodiment utilizes contact of the upper edge of the peripheral sidewall 3 of the cup body 2 with an inward portion of the underside of the flange 16. Furthermore, the fitting of the above-described inner peripheral ridges 4, 5 with the peripheral grooves 14, 15 is used to achieve a liquid-tight seal between the cup body 2 and the flange unit 11.

In having a drink, the user pulls out the flange unit 11 upward to remove it, as shown in FIG. 2. Then, the user can sip the drink smoothly, without feeling any uncomfortable touch to the lips caused by the flange.

Outer peripheral ridges 4*a*, 5*a* are disposed on the outer surface of the peripheral sidewall 3 of the cup body 2 at positions corresponding to the positions of inner peripheral ridges 4, 5 disposed on the inner peripheral surface. These peripheral ridges 4, 4*a*, 5, and 5*a* perform an action and effect as peripheral ribs. At the time when the flange unit 11 is removed as shown in FIG. 2, to let the user have a drink, these ribs can prevent the upper opening of the cup body 2 from deforming. Therefore, the user can get a stable hold of the cup body 2.

After each cup has been filled with a content fluid, such as coffee, the cup containers are sold in a state in which the upper opening of the flange unit 11 is generally sealed with a seal film 19 by adhering the rim portion of the seal film 19 to the upper surface of the flange 16, as shown in FIG. 4. The flange unit 11 can be removed for some sips of the drink, and then can be fitted again to the cup body 2, while the upper opening of the flange unit 11 is kept in the sealed state. Thus, the cup container having the remaining content fluid can be stored or even be carried around with ease.

Figure 5:
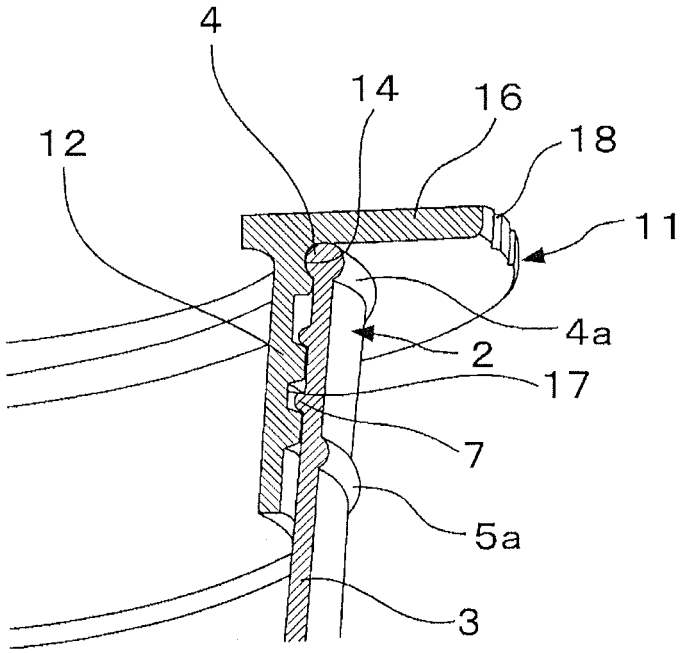
FIG. 5 is an enlarged, diagrammatic perspective view, similar to FIG. 3, of the cup container in this embodiment of this invention, but the cup container shows a different fitting engagement of the cup body with the flange unit.

Like FIG. 3, FIG. 5 is an enlarged diagrammatic perspective view of an important upper portion of the cup container 1 in the first embodiment, with a part in a vertical section, but the cup container 1 shows a different fitting engagement, i.e., a screw engagement of the cup body 2 with the flange unit 11. Except for this new feature associated with the fitting engagement and an additional feature that a knurl pattern, one of irregular surface patterns 18, is formed on the end face of the flange 16, all other features of this first embodiment are similar to those of the cup container shown in FIGS. 1 to 4.

A screw thread 7 is disposed on the inner surface of the peripheral sidewall 3 of the cup body 2. A pair of peripheral ridges 4, 4*a* is disposed in the upper portion of the peripheral sidewall 3 on both the inner and outer surfaces. A peripheral ridge 5*a* is also disposed on the outer surface at a position below the screw thread 7. A spiral groove 17 is disposed in the flange unit 11 so that the spiral groove 17 screws together with the screw thread 7. The engagement of the screw thread 7 with the spiral groove 17 enables the flange unit 11 to be fitted to the cup body 2 firmly in a way that the flange unit 11 cannot be pulled out. The firmly fitted flange unit 11 can be removed easily by unscrewing it. A knurl pattern, one of irregular surface patterns 18, is formed on the end face of the flange 11 for a non-slip purpose so that the screwing/unscrewing can be easily carried out.

Figure 6:
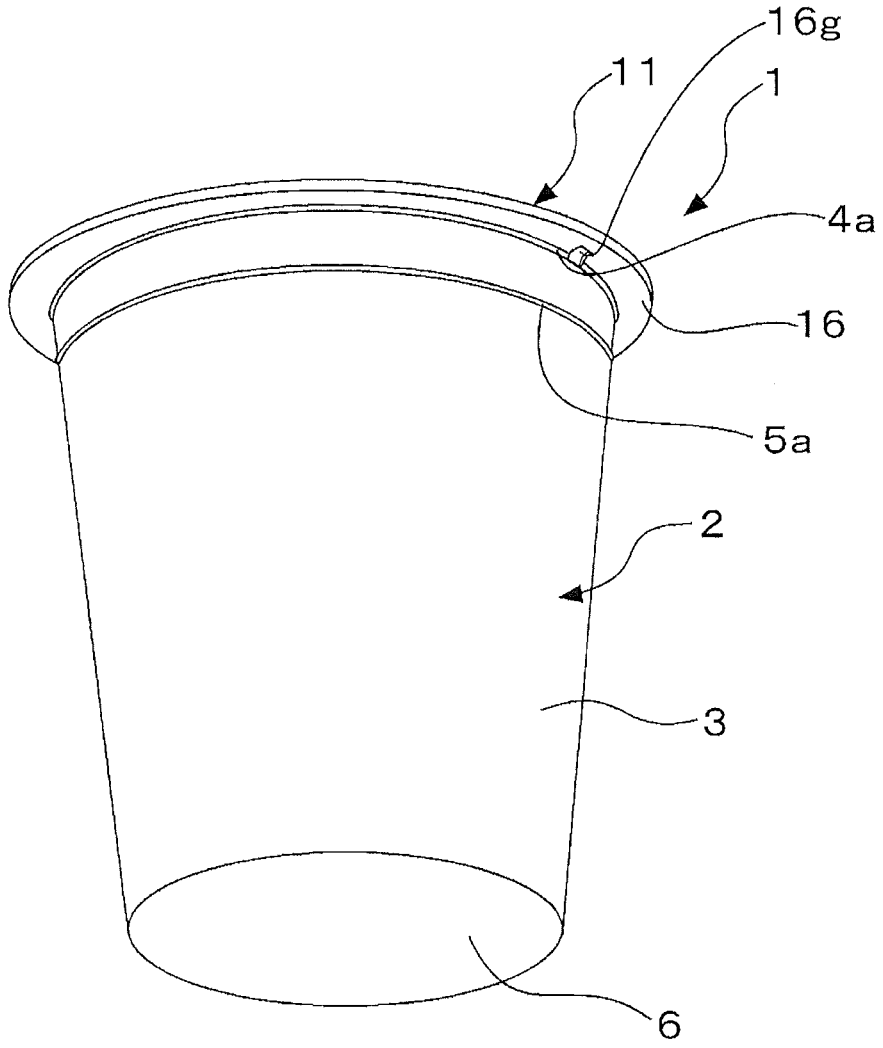
FIG. 6 is a diagrammatic perspective view taken from an oblique upward line of sight, which shows a second embodiment of the cup container of this invention.
Figure 7:
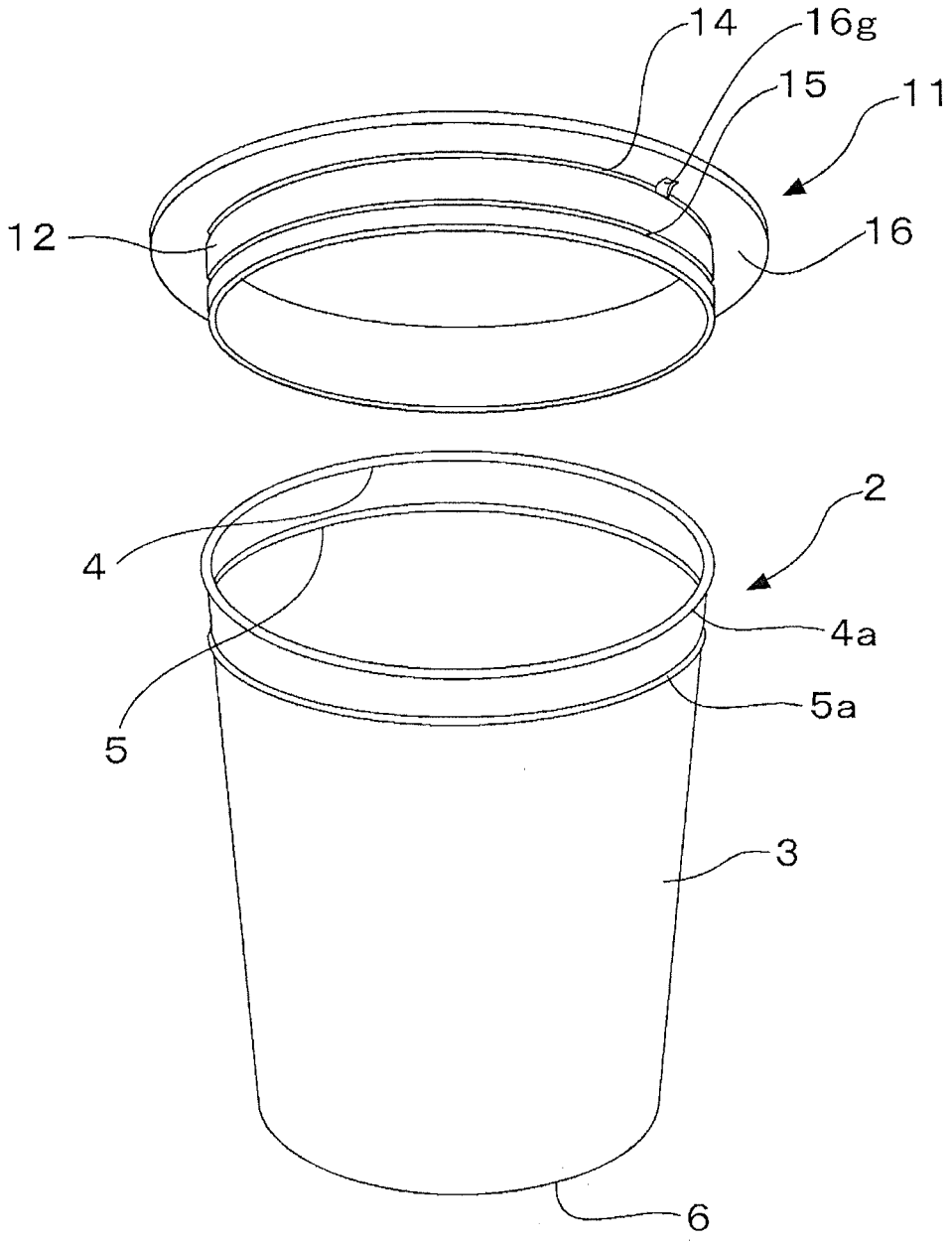
FIG. 7 is a diagrammatic perspective view of the cup container of FIG. 6, in which the flange unit is in a state detached from the cup body.
Figure 8A:
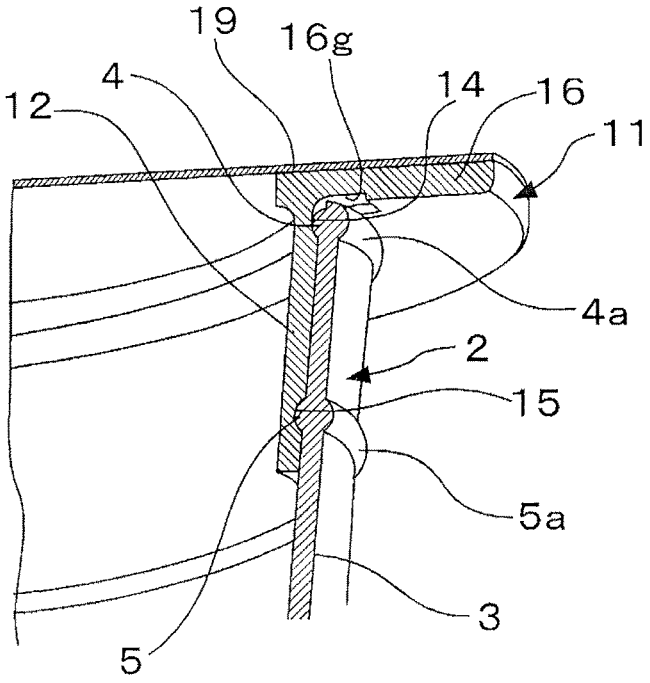
FIG. 8(*a*) is an enlarged, diagrammatic perspective view of an important part of the cup container of FIG. 6, with a portion in a vertical section, taken from an obliquely upward line of sight.
Figure 8B:
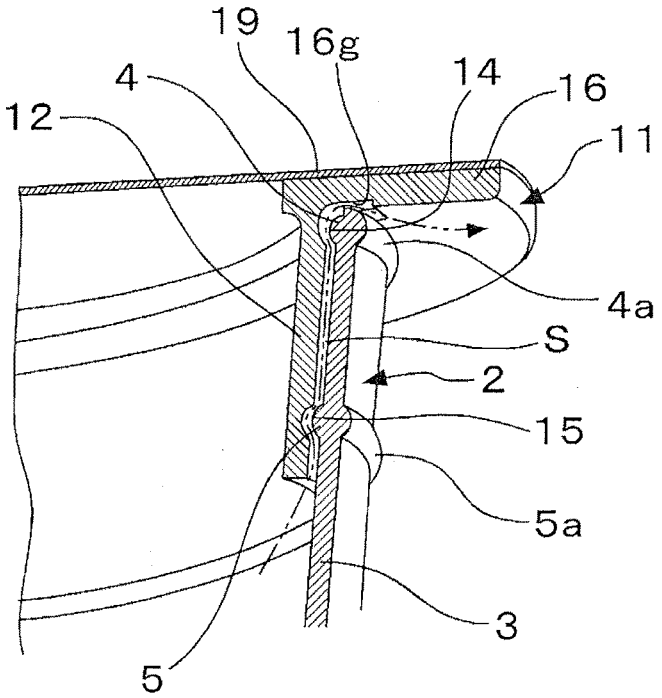
Figure 9:
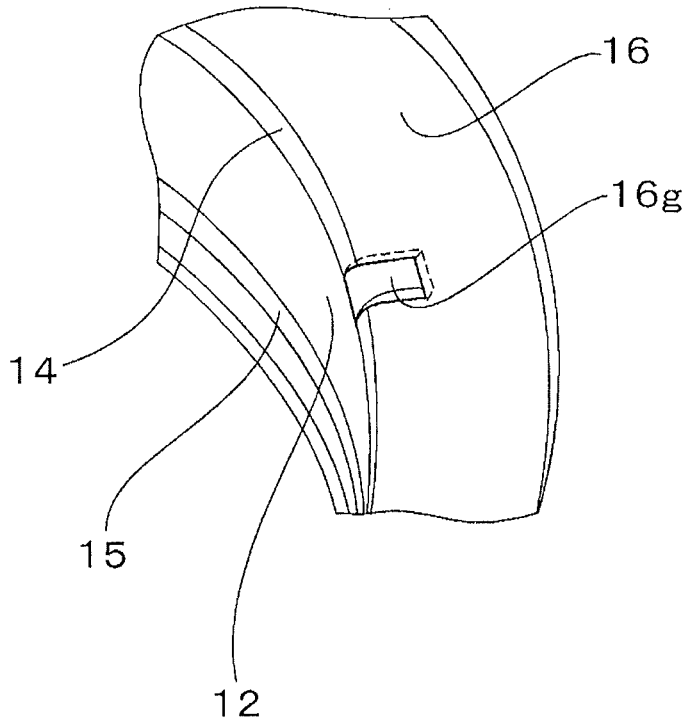
FIG. 9 is an enlarged, diagrammatic perspective view of the flange unit shown in FIG. 7, taken from an obliquely upward line of sight.
Figure 10:
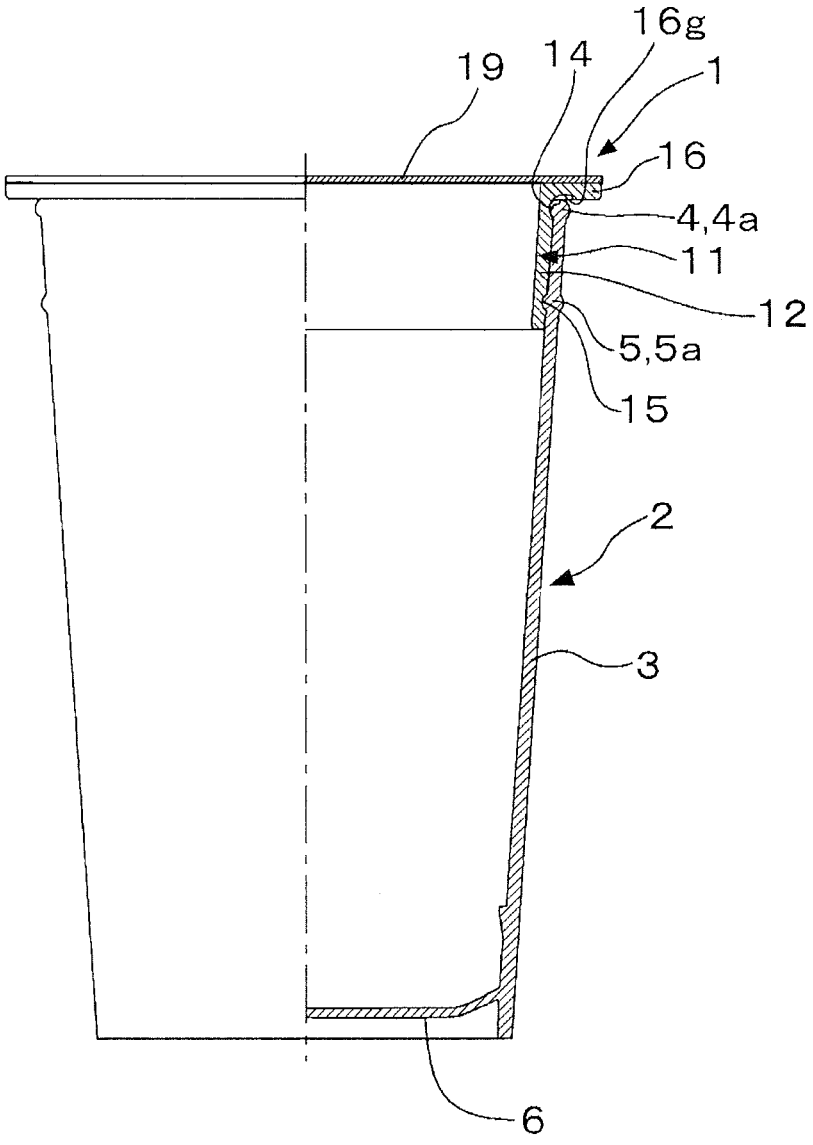
FIG. 10 is a front view, with a right half in a vertical section, of the cup container of FIG. 6.

This invention has been described with respect to its preferred embodiments and their action and effects. However, this invention should not be limited to the first embodiment. In a second embodiment described below, the cup container having the above-described features is also provided with a gas venting mechanism. This feature will be described below while referring to FIGS. 6 to 11. FIG. 6 is a diagrammatic perspective view of the cup container of this second embodiment, and FIG. 7 is a diagrammatic perspective view of the same, in which the flange unit is in a state detached from the cup body 2. FIGS. 8(*a*) and 8(*b*) are enlarged, diagrammatic perspective views of an important part of the cup container of FIG. 6, with a portion in a vertical section. FIG. 9 is an enlarged, diagrammatic perspective view of the flange unit shown in FIG. 7, and FIG. 10 is a front view, with a right half in a vertical section, of the cup container of FIG. 6. FIGS. 8 and 10 show that the upper opening of the flange unit 11 has been sealed with a seal film 19 in a manner that a rim portion of the seal film 19 was adhered to the upper surface of the flange 16 of the flange unit 11.

Like the cup container 1 in the above described first embodiment, the cup container 1 of this second embodiment, too, comprises two members of the cup body 2 and the flange unit 11. Not only that, but a gas venting groove 16*g* is found to be notched in the underside of the flange 16 of this second embodiment, extending in a direction from a point of flange base toward the peripheral end face.

FIG. 8(*b*) is diagrammatic perspective view, similar to FIG. 8(*a*), of a cup container product, which has been obtained by preparing a cup container 1 comprising the cup body 2 and the flange unit 11 of this second embodiment, filling the cup container 1 with a content fluid, such as coffee, and sealing the upper opening of the flange unit 11 with the seal film 19, as shown in FIG. 10, but the inside of the cup has been pressurized by heating the content fluid with a heater.

As shown in this FIG. 8(*b*), the peripheral sidewall 3 of the cup body 2 expands due to a rise in the internal pressure. This expansion creates a gap S between the peripheral sidewall 3 and the fitting cylinder 12 of the flange unit 11 which is fitted into the upper portion of this peripheral sidewall 3 and also between the inner peripheral ridge 4 and the peripheral groove 14. As shown by a two-dot chain line in FIG. 8(*b*), the gas inside the container can escape through this gap S and the gas venting groove 16*g* formed in the underside of the flange 16, and thus, the rise in the pressure inside the container can be effectively controlled. Although a gas venting groove 16*g* is formed in this second embodiment, the cross-sectional shape and number of the groove can be appropriately selected. Furthermore, this gas venting groove 16*g* can be extended, if necessary, so as to include a length ranging from the base of the flange 16 to a lower end position on the outer-surface side of the fitting cylinder 12.

Figure 11:
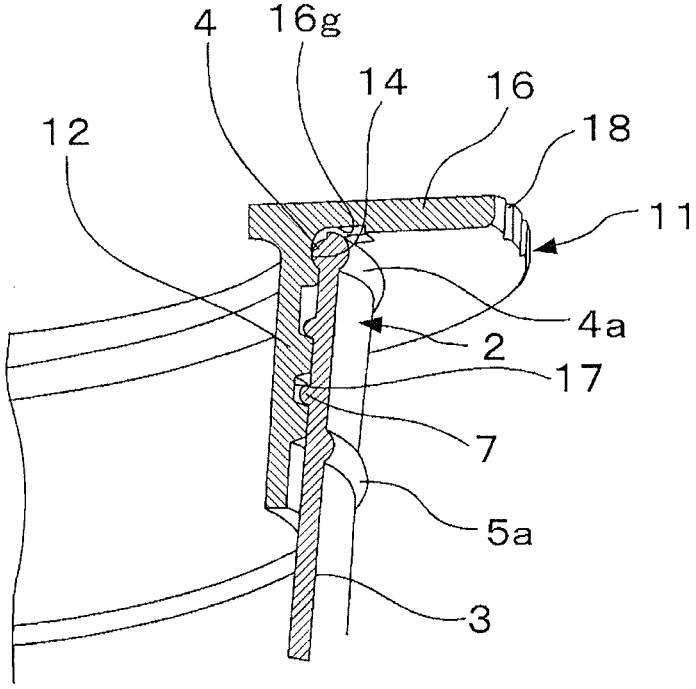
FIG. 11 is an enlarged, diagrammatic perspective view, similar to FIG. 8(*a*), of the cup container in this embodiment of this invention, but the cup container shows a different fitting engagement of the cup body with the flange unit.
Figure 12:
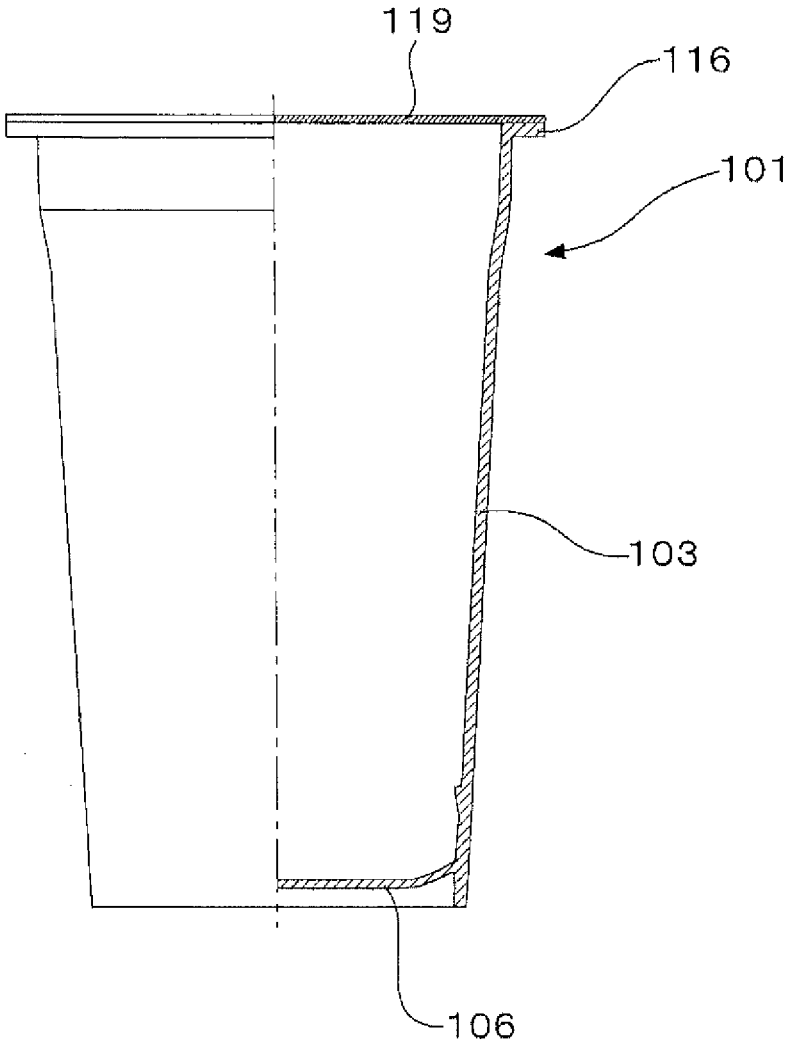
Fig. 12 (PRIOR ART)
FIG. 12 is a front view, with a right half in a vertical section, of a conventional example of the cup container.

FIG. 11 is an enlarged, diagrammatic perspective view of the cup container in the second embodiment of this invention, but the cup container shows a different fitting engagement, in which the cup body 2 is in a screw engagement with the flange unit 11. Like FIG. 8(*a*), FIG. 11 is a diagrammatic perspective view of an important part in the upper portion of the cup container 1. This second embodiment has the same features as shown in FIGS. 6 to 10, except for a different engagement feature and the end face of the flange 16 that has a knurl pattern, one of the irregular surface patterns 18.

A screw thread 7 is disposed on the inner surface of the peripheral sidewall 3 of the cup body 2. A pair of peripheral ridges 4, 4*a* is disposed at the upper edge of the peripheral sidewall 3 on both the inner and outer surface sides. In addition, a peripheral ridge 5*a* is disposed at a position under the screw thread 7 on the outer surface of the peripheral sidewall 3. The flange unit 11 is provided with a spiral groove 17 to engage with the screw thread 7. This screw engagement of the screw thread 7 with the spiral groove 17 allows the flange unit 11 to be fitted tightly to the upper portion of the cup body 2 in a manner unable to pull away the flange unit 11. And yet the tightly fitted flange unit 11 can be unscrewed to remove it easily from the cup body 2. A knurl pattern, one of the irregular surface patterns 18, is formed on the end face of the flange 16 for a nonslip purpose so as to facilitate the screwing or unscrewing operations. Even in the case where the flange unit 11 is fitted to the cup body 2 by the screw engagement, the gas inside the container that has been pressurized can be escaped through a gap between the screw thread 7 and the spiral groove 17, through a gap S formed with the expansion of the peripheral sidewall 3 between the inner peripheral ridge 4 and the peripheral groove 14, and through the gas venting groove 16*g*.

This invention has been described with respect to its embodiments and action-and-effects, but this invention should not be construed as limitative to these embodiments. In the above-described embodiments, the cup body 2 is made of a PP resin, and the flange unit 11 is made of a LDPE resin. However, other synthetic resins, such as a polystyrene resin, a polyethylene terephthalate (PET) resin, and the like, can be utilized, giving consideration to the seal property of the cup body 2 and the flange unit 11, the seal property of the seal film 19, the rigidity of the container, and other factors.

There is also no limitation in the method of liquid-tight sealing between the peripheral sidewall 3 and the fitting cylinder 12 and in the method of fitting the flange unit 11 to the cup body 2. Various sealing methods and fitting methods can be selected arbitrarily, taking into consideration the resistance to pullout and the detachability of the flange unit 11.

INDUSTRIAL APPLICABILITY

As described above, the cup container of this invention has been designed to solve such problems as the difficulty in swallow and uncomfortable touch to the lips caused by the flange, and these problems have been solved by a feature that the cup container comprises two members of a cup body and a removable flange unit. This new cup container is expected to have a wide range of applications of use in the field of foods and beverages, including coffee, juice, yogurt, and the like. If the flange is provided with one or more gas venting grooves, the cup container of this invention can effectively control a rise in pressure inside the container. Because of this gas escape function, the cup container can be used safely and reliably, and thus is expected to have a wide range of application of use in the field where the content fluids are heated before use.

The invention claimed is:

1. A synthetic resin cup container comprising:

a cup body having a cylindrical shape and a bottom disposed at a lower end of a round peripheral sidewall of the cup body, an upper portion of the peripheral sidewall including a first peripheral ridge and a second peripheral ridge, the second peripheral ridge disposed below the first peripheral ridge, the first peripheral ridge defining an inner peripheral ridge on an inner surface of the peripheral sidewall and an outer peripheral ridge on an outer surface of the peripheral sidewall, the outer peripheral ridge being disposed at a position on the outer surface of the peripheral sidewall that corresponds to a position of the inner peripheral ridge on the inner surface of the peripheral sidewall; and a flange unit comprising a fitting cylinder and a brim-like flange, an inner edge portion of the brim-like flange being integrally connected to an upper end of the fitting cylinder, wherein:

an outer peripheral surface of the fitting cylinder includes a first peripheral groove and a second peripheral groove, and the flange unit is detachably fitted in an upper portion of the cup body by fitting the fitting cylinder in the upper portion of the peripheral sidewall of the cup body such that the first peripheral ridge is in fitting engagement with the first peripheral groove and that the second peripheral ridge is in fitting engagement with the second peripheral groove.

2. The synthetic resin cup container according to claim 1, wherein a rim portion of a circular seal film is adhered to an upper surface of the brim-like flange of the flange unit to seal an upper opening of the flange unit.

3. The synthetic resin cup container according to claim 1, wherein the second peripheral ridge includes an inner peripheral ridge and an outer peripheral ridge.

4. The synthetic resin cup container according to claim 1, wherein an upper end portion of the peripheral sidewall and the fitting cylinder are engaged to each other.

5. The synthetic resin cup container according to claim 4, wherein an irregular surface pattern is put on the brim-like flange for a nonslip purpose.

6. The synthetic resin cup container according to claim 1, wherein one or more gas venting grooves is formed in an underside of the brim-like flange in the direction of an outer peripheral edge.

7. A synthetic resin cup container comprising:

a cup body having a cylindrical shape and a bottom disposed at a lower end of a round peripheral sidewall of the cup body, an upper portion of the peripheral sidewall includes a peripheral ridge and a screw thread, the screw thread disposed below the peripheral ridge, the peripheral ridge defining an inner peripheral ridge on an inner surface of the peripheral sidewall and an outer peripheral ridge on an outer surface of the peripheral sidewall, the outer peripheral ridge being disposed at a position on the outer surface of the peripheral sidewall that corresponds to a position of the inner peripheral ridge on the inner surface of the peripheral sidewall and a flange unit comprising a fitting cylinder and a brim-like flange, an inner edge portion of the brim-like flange being integrally connected to an upper end of the fitting cylinder, an outer peripheral surface of the fitting cylinder includes a peripheral groove and a spiral groove, the spiral groove disposed below the peripheral groove, wherein the flange unit is detachably fitted in an upper portion of the cup body by fitting the fitting cylinder in the upper portion of the peripheral sidewall of the cup body such that the peripheral ridge is in fitting engagement with the peripheral groove and that the screw thread is in fitting engagement with the spiral groove.

8. The synthetic resin cup container according to claim 7, wherein the brim-like flange extends outward from the upper edge of the fitting cylinder.

* * * * *